United States Patent [19]

Eguizabal

[11] Patent Number: 4,461,109

[45] Date of Patent: Jul. 24, 1984

[54] FIREARM WITH NOVEL BREECH PLUG AND BOLSTER ASSEMBLY

[75] Inventor: Julian Eguizabal, Canaries, Spain

[73] Assignee: Connecticut Valley Manufacturing, Inc., Haddam, Conn.

[21] Appl. No.: 388,025

[22] Filed: Jun. 14, 1982

[51] Int. Cl.[3] ..... F41C 27/00

[52] U.S. Cl. ..... 42/51; 42/83

[58] Field of Search ..... 42/51, 83, 76 R; 29/1.1

[56] References Cited

U.S. PATENT DOCUMENTS

| | | | |
|---|---|---|---|
| 15,292 | 7/1856 | Halsey | 42/51 |
| 21,802 | 10/1858 | Schenkl | 42/51 |
| 28,677 | 6/1860 | Lord | 42/83 |
| 36,464 | 9/1862 | Hopkins | 42/51 |
| 4,065,866 | 1/1978 | Eguizabal | 42/51 |
| 4,137,663 | 2/1979 | Farber | 42/51 |

FOREIGN PATENT DOCUMENTS

| | | | |
|---|---|---|---|
| 2403 | 11/1871 | France | 42/51 |

*Primary Examiner*—Charles T. Jordan

[57] ABSTRACT

A muzzle loading firearm has a barrel bore into one end of which is force fitted a breech plug. The barrel wall has a radial aperture through one side and a diamaterally opposed recess in its inner surface, and the breech plug has a diamaterally extending passage aligned with the aperture and recess in the barrel wall. In one embodiment, a bolster is force fit into the barrel aperture, breech plug passage and barrel recess. The breech plug has a bore in its inner end communicating with the passage therein, and the bolster has a flash chamber and passage aligned with the breech plug bore.

17 Claims, 5 Drawing Figures

FIREARM WITH NOVEL BREECH PLUG AND BOLSTER ASSEMBLY

BACKGROUND OF THE INVENTION

This invention relates to muzzle loading firearms, and more particularly to a breech plug and bolster assembly and to a method for fabricating such an assembly. Muzzle loading firearms include percussion cap or flintlock muzzle loading rifles and pistols. Although such firearms are technologically obsolete, they are still manufactured for collectors and enthusiasts who maintain and fire such weapons.

In the prior muzzle loading firearms, the firing of the powder charge to propel the projectile from the barrel generated firing forces acting against the bolster to bias it in a direction tending to displace the bolster out of the aperture in which it was threaded. The firing forces similarly acted against the breech plug to bias it in a direction tending to displace the breech plug rearwardly and out of the barrel. The threaded engagement of the breech plug and bolster has been the principal means resisting the displacement action of the firing forces. As the threads weaken with wear or with age and repeated firings, safety and proper functioning of the firearm may be adversely affected.

The firearm assembly disclosed in applicant's prior U.S. Pat. No. 4,065,866 provides a bolster design that precludes the firing forces from biasing the bolster outwardly of the aperture in which it is mounted and shields the breech plug from the firing forces tending to displace the breech plug out of the barrel. It has proven highly effective in the years of use since its introduction.

However, in manufacturing devices of this type, it is required that the barrel stock be prepared for the breech plug by facing, tapping, undercutting of thread, and chamfering in a screw machine. The breech plug is threaded and, therefore, must be cast or milled. The breech plug is then assembled to the barrel by male and female threads which have to be torqued to accomplish a gas-tight seal. A flat surface of the barrel has to be aligned with a flat surface of the breech plug while the torque is applied. A threaded bolster engages the threaded hole in the barrel and breech plug assembly, thereby necessitating a threading operation for the bolster and the tapping of the mating hole in the barrel and breech plug. The threaded assembly necessitates that the "communication" hole in the bolster (to allow the primer to ignite the main powder charge) be drilled in the bolster after it is assembled to the barrel. This is accomplished by a long drill entering the muzzle end of the barrel. Additionally, the threaded hole in the bolster which receives the nipple is also drilled and tapped after the bolster is assembled to the barrel. These several steps require relatively expensive and accurate operations.

It is an object of the present invention to provide a novel breech plug and bolster assembly in a muzzle loading firearm providing a long-lived assembly which may be readily fabricated.

It is also an object to provide such a breech plug and bolster assembly wherein the bolster extends through the breech plug and is securely engaged with both sides of the barrel to pin the breech plug in place.

Another object is to provide such a breech plug and bolster assembly wherein the parts may be press-fitted into assembly.

A further object is to provide such a breech plug and bolster assembly with relatively simple manufacturing operational steps.

A still further object is to provide such a breech plug and bolster configuration and method of assembly that allows predrilling of the bolster prior to assembly.

Yet another object is to provide such a breech plug and bolster assembly that is economical to manufacture, durable and safe in use, and refined in appearance.

SUMMARY OF THE INVENTION

It has now been found that the foregoing and related objects and advantages can be readily attained in a muzzle loading firearm assembly which includes barrel a having a breech end, a muzzle end, and a bore extending longitudinally therethrough to define a generally annular barrel wall. The barrel wall has an aperture extending radially therethrough adjacent the breech end and opening into the bore, and a recess in the inner surface of the barrel wall diametrically aligned with the barrel aperture. An elongated breech plug has a body portion seated within the bore at the breech end, and it extends within the bore from the breech end to beyond the aperture in the barrel wall. A passage extends diametrically through its body portion in alignment with the barrel wall aperture and recess. The breech plug also has a bore extending axially from the inner end of the plug and opening into the passage.

Seated in the barrel and breech plug is a bolster which has an elongated cylindrical shank portion and a stem portion with the shank portion being seated in the barrel aperture, breech plug passage, and barrel recess to retain the breech plug in place against biasing of the breech plug outwardly from firing forces. A flash chamber is formed in the bolster and opens into the barrel bore through the breech plug bore. This flash chamber is adapted to receive a powder charge therein, and the bolster also has a flash transfer passage which extends between the flash chamber and the exterior of the stem portion of the bolster to provide a path for transmission of a flash from the exterior of the barrel to the flash chamber.

In the preferred embodiment, the body portion of the breech plug is dimensioned and configured to closely approximate the dimension and configuration of the barrel bore so that it is in force fitted engagement within the bore. The shank portion of the bolster is dimensioned and configured to closely approximate the configuration and dimension of the breech plug passage and of the barrel wall aperture and recess, and it is in force fitted engagement with the barrel and breech plug. A sealant is interposed between the shank of the bolster and the wall of the breech plug defining the passage and between the shank and the barrel aperture.

In an alternate embodiment, the breech plug in the barrel is force fitted, and there is a threaded connection between the shank of the bolster to the passage in the breech plug.

Preferably, the stem portion of the bolster has a greater transverse dimension than that of the shank portion to provide a shoulder abutting the outer surface of the barrel. Sealant is provided between the abutting surfaces.

In the method for fabricating this breech plug and bolster assembly, the barrel is formed with a breech end, a muzzle end, and a bore extending longitudinally therethrough to define a generally annular barrel wall with an aperture extending radially therethrough adjacent the breech end and with a diametrically aligned recess in the inner surface of the barrel wall. The breech plug is formed with a body portion with an outer surface dimensioned and configured to closely approximate the dimension and configuration of the barrel bore and with a passage extending diametrically therethrough and a bore extending axially from its inner end and opening into the passage.

The bolster is formed with an elongated cylindrical shank portion and a stem portion. It is also formed with a flash chamber in the stem portion opening to the exterior surface thereof and a longitudinally extending passage between the flash chamber and the exterior of the bolster stem portion.

The breech plug is press fit into the breech end of the bore in force fitted engagement to close the breech end of the barrel, with the passage of the breech plug in alignment with the aperture and recess of the barrel wall. The shank portion of the bolster is then seated in the barrel aperture, breech plug passage, and recess to pin the breech plug in place, and with its passage opening in the shank portion aligned with the breech plug bore.

The bolster is preferably formed so that the cylindrical shank portion is dimensioned and configured to closely approximate the configuration and dimension of the barrel wall aperture, breech plug passage and barrel wall recess, so that it may be press fit in force fitted engagement therewith. Desirably, sealant is interposed between the mating surfaces of the breech plug and the annular barrel wall and between the mating surfaces of the shank of the bolster and the wall of the breech plug passage and the barrel aperture.

DETAILED DESCRIPTION OF THE ILLUSTRATED EMBODIMENT

In the attached drawings, there is illustrated a barrel assembly including the breech plug and bolster assembly of this invention. It is generally comprised of a barrel generally designated by the numeral 10, a breech plug generally designated by the numeral 12, and a bolster generally designated by the numeral 14. The basic structure and operation of muzzle loading firearms related to this invention are disclosed in the applicant's prior U.S. Pat. No. 4,065,866, which is incorporated herein by reference.

Figure 1:
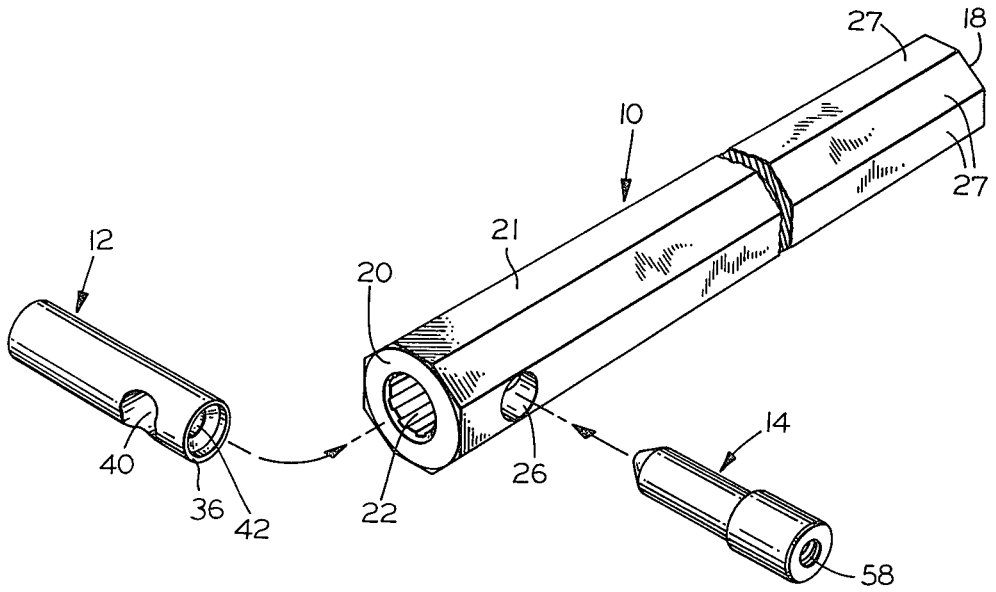
FIG. 1 is an exploded fragmentary perspective view of the barrel assembly of a muzzle loading firearm embodying the present invention.
Figure 2:
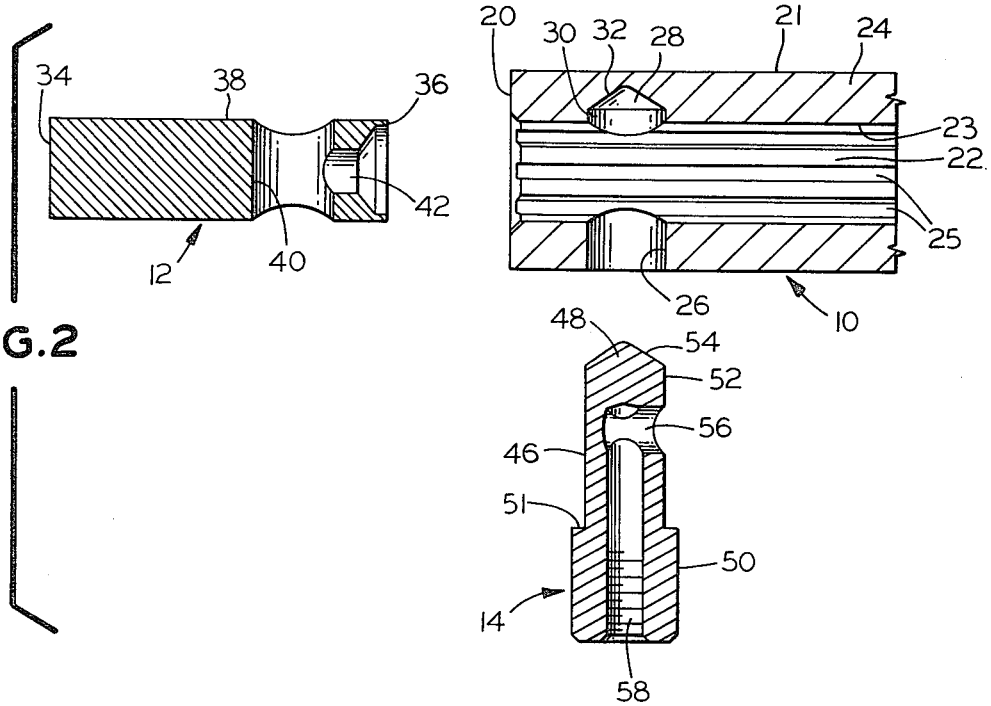
FIG. 2 is an enlarged exploded fragmentary sectional view of the assembly of FIG. 1.

The barrel 10 of the muzzle loading firearm has a muzzle end 18, a breech end 20, and a bore 22 extending longitudinally therethrough to define a generally annular barrel wall 24. The inner surface 23 of wall 24 has a plurality of longitudinally extending rifling grooves 25 as shown in FIG. 2, and the outer surface 21 of barrel wall 24 is actually polygonal in transverse cross-section and defined by a series of longitudinally aligned flat surfaces 27. As shown in FIG. 2, a bolster receiving aperture 26 extends radially through barrel wall 24 adjacent the breech end 20 and opens into the bore 22. The inner surface of the barrel wall 24 has a recess 28 diametrically aligned with the aperture 26. The recess 28 has a portion 30 of circular cross section adjacent the bore 22 and terminates in a tapered or conical end portion 32.

Figure 3:
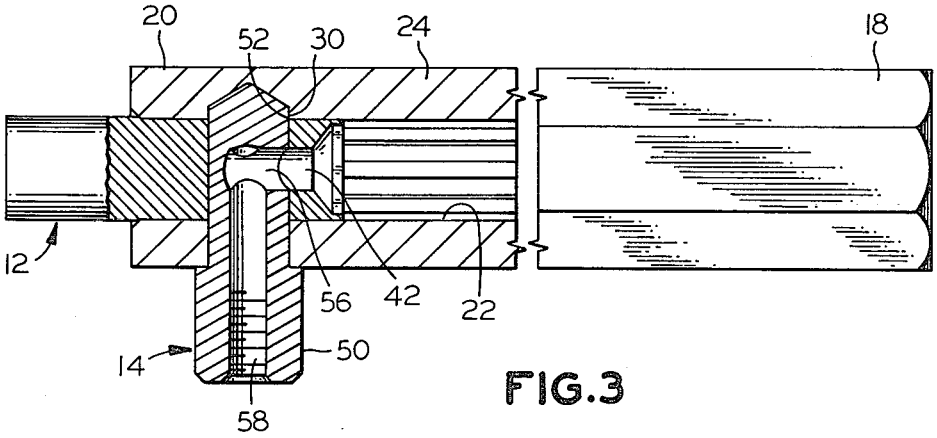
FIG. 3 is an enlarged fragmentary plan view of the assembly with portions broken away for clarity of illustration.

Turning now in detail to the breech plug 12, it is of elongated cylindrical configuration with an outer end 34, and inner end 36, and a bolster receiving passage 40 extends diametrically through the breech plug 12 adjacent its inner end 36. As shown in FIG. 3, the body of the breech plug 12 is seated in the breech end of the bore 22 to close the breech end and extends within the bore 22 from the breech end 20 to beyond the barrel aperture 26. The breech plug 12 has a bore 42 extending axially from its inner end 36 and opening into the passage 40 so as to open into bore 22 when the breech plug 12 is seated in the barrel 10. The outer surface of the breech plug 12 is dimensioned and configured to closely approximate the dimension and configuration of bore 22 so that it can be press fit in to force-fitted engagement with the barrel 10.

As seen in FIG. 2, the bolster 14 has an elongated cylindrical shank portion 46 extending into the barrel 10 and breech plug 12, and an outer stem portion 50. Adjacent its inner end, the shank porton 46 has a portion 52 of generally cylindical configuration and it terminates in a conical or tapered portion 54 cooperating with the configuration of the recess 28 in the barrel 10. A flash chamber 56 is formed in the shank portion 46 and extends radially to open into the bore 22 of the barrel 10 through the bore 42 in the breech plug 12. A flash transfer passage 58 extends from the flash chamber 56 through the exterior of the stem portion 50 so as to permit a flash to be transmitted from the exterior of the assembly to the bore 22 of the barrel 10. The shank portion 46 of the bolster 14 is dimensioned and configured to closely approximate the configuration and dimension of aperture 26 and recess 28 in the barrel wall 24 and of the passage 40 of the breech plug 12 so that it may be press fit into force fitting engagement in the aperture 26 of the barrel and the passage 40 of the plug 12. Since the stem portion 50 is of greater transverse dimension than the shank portion 46, a shoulder 51 is provided and this bears upon the flat surface 27 about the aperture 26.

When assembled, the shank portion 46 of the bolster 14 extends through aperture 26 in the barrel 10 and passage 40 of the breech plug 12, and its conical portion 54 is received in the conical portion 32 of the recess 28. The cylindrical portion 52 of the bolster 14 snugly seats in the circular cross section portion 30 of the recess 28 so as to secure breech plug 12 in barrel 10 in the position shown in FIG. 3. The "pinning" of the breech plug 12 on diametrically opposed sides of barrel 10 securely locks the breech plug 12 against the outward forces of the gunpowder explosion.

In assembling the several components, the breech plug 12 is press fit into force fitting engagement within the bore 22 at the breech end 20 of the barrel 10 with the passage 40 in direct alignment with the aperture 26 of the barrel wall 24. The bolster 14 is then press fit into force fitting engagement through the aperture 26 of the barrel wall 24, through the passage 40 of the breech plug 12, and then seated within recess 28 while aligning the bolster 14 so that flash chamber 56 of the bolster 14 is in direct alignment with the bore 42 in the breech plug 12. Thus, flash chamber 56 opens directly into bore 22 through the bore 42 and communicates with the exterior of the assembly through the flash transfer passage 58.

Figure 5:
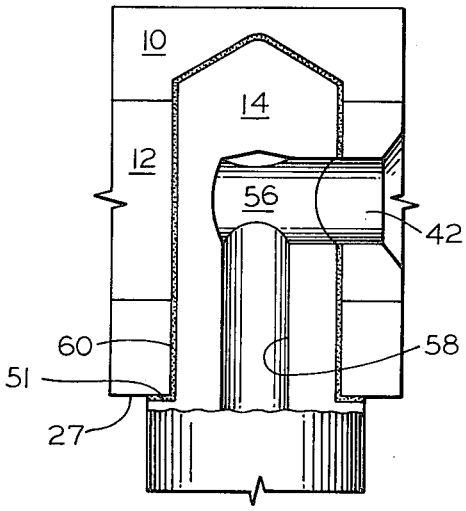
FIG. 5 is an fragmentary sectional view to an enlarged scale similar to FIG. 3 and diagramatically illustrating the sealant.

In FIG. 5, the parts have been enlarged to show an intermediate layer 60 of a sealant filling any voids between the opposed surfaces of the parts. In this manner, the frictional resistance to disengagement of the parts is increased and there is minimized any tendency for a path for exploding gases to develop.

Figure 4:
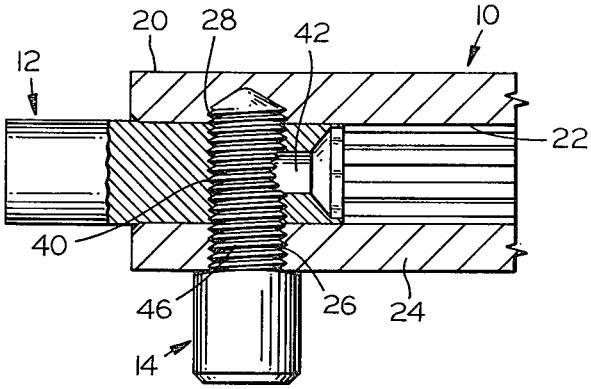
FIG. 4 is a fragmentary view similar to FIG. 3 illustrating an alternate embodiment of bolster assembly.

Turning now to FIG. 4, an alternate embodiment is shown wherein identical parts are identified by the corresponding numerals. In this embodiment, the aperture 26 of barrel 10, the passage 40 of the breech plug 12, and the recess 28 are tapped and threaded to threadably engage the threaded shank portion 46 of the bolster 14. In assembling the parts, the breech plug 12 is similarly press fit into the bore 22 of barrel 10 and the bolster 14 is threadably inserted into aperture 26 of barrel wall 24, passage 40 of breech plug 12, and the recess 28 to securely pin the breech plug 12. The threading of the parts into assembly must effect alignment of the flash chamber 56 with the bore 42 of the breech plug 12. Alternatively, a drilling operation can be used to form the flash chamber 56 using the bore 42 as a guide.

In use, a powder charge (not shown) is loaded from the muzzle end 18 of the barrel 10 into flash chamber 56 of the bolster, recess 42 of the breech plug and a portion of bore 22. A projectile (not shown) is also loaded from muzzle end 18 of the barrel to a position adjacent and in front of the powder charge. A flash is generated in the flash transfer passage 58 in a known manner as by the firing of a percussion cap so as to ignite the powder charge in the flash chamber 56. The resultant firing forces propel the projectile from the barrel 10. As can be seen, during the firing, the bolster 14 pins the breech plug 12 in position within the barrel 10 against the outwardly biasing firing forces to provide a secure mounting of the breech plug 12 within the bore 22. Thus, the interlocking configuration of the bolster 14 and the barrel 10 securely maintains the breech plug 12 in place.

In the manufacturing and assembling process for the preferred embodiment, the breech plug may be manufactured from round, cold rolled stock machined on an automatic screw machine as compared to prior breech plugs that were cast or milled and then threaded. Because of the press fit assembly of the barrel and breech plug, the barrel need only be cut to the desired length on a precision saw and drilled in preparation for insertion of the breech plug as compared to the prior preparatory steps of facing, tapping, undercutting of thread, and chamfering of the barrel in a screw machine since the prior step of torquing the threaded connection of the breech plug and barrel to obtain a gas tight seal is eliminated. Also eliminated is the threading operation for the bolster and the threading of the aperture in the barrel and of the passage in the breech plug. Since the flash chamber can be drilled in the bolster prior to assembly, the prior procedure of drilling the flash chamber after assembly by a long drill from the muzzle end of the barrel is avoided.

In the embodiment of FIG. 4, the assembly is more gas-tight by reason of the tortuous path provided by the mating threads of the bolster and cooperating surfaces. This approach, however, does require tapping and threading the barrel and breech plug, and threading the bolster. It also requires closely controlling the assembly process to align the predrilled flash chamber in the bolster with the bores of the breech plug and barrel, or using a long drill to drill the flash chamber after assembly using the bore in the breech plug as a guide.

Whichever embodiment is employed, a sealant should be provided on the mating surfaces of barrel and breech plug, and of bolster, breech plug and barrel so as to fill any voids and minimize the tendency for the hot gases to effect the gradual erosion of a passage between the mating surfaces. An anaerobic sealant such as the polyacrylate sealants sold under the trademark LOCTITE by Loctite Corporation is desirably employed.

Thus it can be seen that from the foregoing detailed specifications and drawings that the present invention provides a breech plug and bolster assembly for muzzle loading firearms which may be effected relatively easily and which provides a high strength, long-lived assembly. The breech plug is assembled simply by force fitting into the barrel bore, and the bolster pins the breech plug securely in the barrel.

I claim:

1. In a muzzle loading firearm adapted to fire a powder charge contained therein, the combination comprising:

(a) a barrel having a breech end, a muzzle end, and a bore extending longitudinally therethrough to define therein a generally annular barrel wall, said barrel adjacent said breech end having an aperture extending radially through said barrel wall and opening into said bore and a recess in the inner surface of said barrel wall diametrically aligned with said aperture;

(b) an elongated breech plug having a body portion seated in and closing said breech end of said bore, said plug body portion extending within said bore from said breech end to beyond said aperture in said barrel wall, said plug body portion having a passage extending diametrically therethrough in alignment with said barrel wall aperture and recess, said plug also having a bore extending axially therein from its inner end and opening into said passage; and (c) a bolster having an elongated cylindrical shank portion and a stem portion, said shank portion being seated in said barrel aperture, breech plug passage and barrel recess to retain said breech plug in place against biasing of said breech plug outwardly of said breech end of said barrel, said bolster also having a flash chamber formed in said shank portion and opening into said barrel bore through said bore in said breech plug, said flash chamber being adapted to receive a powder charge therein, and said bolster further having a flash transfer passage extending between said flash chamber and the exterior of said stem portion of said bolster to provide a path for transmission of a flash from the exterior of said barrel to said flash chamber.

2. The combination of claim 1 wherein said body portion of said breech plug has an outer surface dimensioned and configured to closely approximate the dimension and configuration of said barrel bore, said plug body portion being in force-fitted engagement within said bore.

3. The combination of claim 1 wherein a sealant is interposed between said breech plug and said annular barrel wall.

4. The combination of claim 1 wherein said shank portion of said bolster is dimensioned and configured to closely approximate the configuration and dimensions of said barrel wall aperture and recess and of the said breech plug passage, and wherein said stem portion of said bolster is of greater transverse dimension than said shank to provide a shoulder bearing upon the outer surface of said barrel about said aperture.

5. The combination of claim 4 wherein a sealant is interposed between said shank of said bolster and the wall of said breech plug defining said passage therein and between said shank and the wall defining said barrel aperture.

6. The combination of claim 5 wherein said sealant is also interposed between said shoulder of said stem portion of said bolster and the underlying portion of the outer wall of said barrel.

7. The combination of claim 4 wherein said outer surface of said barrel wall is polygonal in transverse cross-section defined by a multiplicity of flat portions and said shoulder of said stem portion abuts tightly one of said flats.

8. The combination of claim 7 wherein a sealant is interposed between said shoulder and said one flat.

9. The combination of claim 1 wherein the inner end of said shank of said bolster is of generally conical configuration and said recess in said annular barrel wall is cooperatively configured.

10. The combination of claim 1 wherein said barrel aperture and said passage of said breech plug are threaded and said shank of said bolster has a threaded outer surface threadably engaged with said threaded barrel aperture and said threaded passage of said breech plug.

11. The combination of claim 10 wherein said recess in said barrel wall is threaded and is threadably engaged with the end of said bolster.

12. The combination of claim 1 wherein said shank portion of said bolster is in force fitted engagement within said aperture and recess of said barrel.

13. In a method for fabricating a muzzle loading firearm with a breech plug and bolster assembly, the steps comprising (a) forming a barrel having a breech end, a muzzle end, and a bore extending longitudinally therethrough to define a generally annular barrel wall and providing an aperture extending radially through said barrel wall adjacent the breech end and a diametrically aligned recess in the inner surface of the barrel wall opposite said aperture;

(b) forming a breech plug having a body portion with an outer surface dimensioned and configured to closely approximate the dimension and configuration of said barrel bore for force-fitting engagement to close said breech end and forming therein a passage diametrically therethrough adjacent one end and a bore extending axially from said one end and opening into the passage;

(c) forming a bolster having an elongated cylindrical shank portion and a stem portion, and providing a flash chamber in said shank portion opening to the exterior surface thereof and a longitudinally extending passage extending between said flash chamber and the exterior of said bolster stem portion;

(d) force-fitting said breech plug into said breech end of said bore to close said breech end while aligning said passage therein with said aperture and recess of said barrel wall; and (e) seating said shank portion of said bolster in said barrel aperture, breech plug passage, and recess to pin said breech plug in place while aligning said passage opening in said shank portion with said breech plug bore.

14. The method of claim 13 wherein the step (c) of forming said bolster includes forming said elongated cylindrical shank portion with dimensioning and configuration to closely approximate the configuration and dimensioning of said barrel wall aperture, breech plug passage, and barrel wall recess; and wherein the step (e) of seating said shank portion of said bolster includes press-fitting said shank portion of said bolster in said barrel wall aperture, breech plug passage and barrel wall recess.

15. The method of claim 13 additionally including the steps of:

(i) threading said shank portion of said bolster, (ii) tapping said barrel aperture and breech plug passage, and (iii) threadably engaging said shank portion in said barrel aperture and breech plug passage.

16. The method of claim 13 further including the step of interposing a sealant between said bolster and the surface of said barrel wall defining said aperture therein.

17. The method of claim 16 further including the step of interposing a sealant between said bolster and said breech plug.

* * * * *